US011022371B2

(12) United States Patent
Paulin

(10) Patent No.: US 11,022,371 B2
(45) Date of Patent: Jun. 1, 2021

(54) THERMAL GRADIENT EXCHANGE MATERIALS PROCESSING METHOD

(71) Applicant: Peter Paulin, Decatur, IL (US)

(72) Inventor: Peter Paulin, Decatur, IL (US)

( * ) Notice: Subject to any disclaimer, the term of this patent is extended or adjusted under 35 U.S.C. 154(b) by 0 days.

(21) Appl. No.: 15/985,100

(22) Filed: May 21, 2018

(65) Prior Publication Data

US 2019/0353423 A1 Nov. 21, 2019

Related U.S. Application Data

(63) Continuation of application No. 14/777,305, filed as application No. PCT/US2014/030007 on Mar. 15, 2014, now Pat. No. 10,001,323.

(60) Provisional application No. 61/787,057, filed on Mar. 15, 2013.

(51) Int. Cl.

| | |
|---|---|
| ***F27B 9/14*** | (2006.01) |
| ***F27B 9/24*** | (2006.01) |
| ***F27B 9/40*** | (2006.01) |
| *F27B 1/26* | (2006.01) |
| *F27B 9/39* | (2006.01) |

(52) U.S. Cl.

CPC ..... *F27B 9/142* (2013.01); *F27B 9/2461* (2013.01); *F27B 9/40* (2013.01); *F27B 1/26* (2013.01); *F27B 9/39* (2013.01)

(58) Field of Classification Search

CPC ..... F27B 1/26; F27B 9/142; F27B 9/2461; F27B 9/39; F27B 9/40

USPC ..... 432/11

See application file for complete search history.

(56) References Cited

U.S. PATENT DOCUMENTS 2,797,075 A * 6/1957 Sinclair ..... B65G 23/00 432/45

2,980,411 A * 4/1961 Buckholdt ..... C21D 9/56 226/91

* cited by examiner

*Primary Examiner* — Steven B McAllister
*Assistant Examiner* — Benjamin W Johnson
(74) *Attorney, Agent, or Firm* — Law Office of Jerry Joseph. PLC; Jerry Joseph

(57) ABSTRACT

A method of thermally processing work pieces including providing an insulated chamber having a first end, an opposing second end, and a middle portion disposed between the first and second ends, wherein the first end is inclined with respect to middle portion, creating a thermal gradient within an interior of the insulated chamber, and providing a means for gradually moving a workpiece from the first end to the second end within the created thermal gradient.

8 Claims, 8 Drawing Sheets

THERMAL GRADIENT EXCHANGE MATERIALS PROCESSING METHOD

CROSS-REFERENCE TO RELATED APPLICATIONS

This application claims the benefit of U.S. Provisional Patent Application No. 61/787,057, filed on Mar. 15, 2013, International Patent Application No. PCT/US2014/030007, filed on Mar. 15, 2014, and U.S. Non-Provisional patent application Ser. No. 14/777,305 filed on Sep. 15, 2015, the disclosures of which are incorporated herein in their entirety by reference.

TECHNICAL FIELD

The present inventive concept relates to a method and apparatus for thermal processing of a work piece, and more particularly a method and apparatus for thermal processing a metal work piece using another metal work piece undergoing thermal processing.

The present inventive concept further relates to a materials processing method and related device utilizing a thermal gradient exchange in an essentially static gas or liquid medium. The preferred method and device utilize slow movement of the subject material through the essentially static medium countercurrently through the respective thermal gradient.

BACKGROUND ART

The utilization of thermal alteration of a material is well-known, a simple example comprising the tempering of ferrous alloys such as steel or cast iron wherein the hardness of the alloy is decreased, increasing ductility and toughness of the alloy. This is achieved, generally, by lowering the material below a critical lower transformation temperature altering the crystalline phases of the alloy. Other materials, for instance, glass, are also well-known to benefit from thermal alteration.

In general, in the art, it is well-known to heat or cool a material directly; for example, placing materials in an oven, or general refrigeration of materials by a coolant/compressor heat extraction system in order to achieve a desired thermal change. These are very energy intensive processes. In particular, these apply much energy with high thermal change requirements, i.e., significant temperature changes.

In contrast to the prior art, the present invention utilizes a thermal gradient to effect a desired temperature change without such significant energy inputs to the system. Surprisingly, the alteration of the acted upon material retains the desired effect without these high energy inputs while producing the desired thermal effects. The significant need in the art for this more energy efficient method is therefore easily understood.

While these and other prior art methods may be suitable for their intended applications, none of them solve the various problems addressed by the present invention.

SUMMARY OF THE INVENTION

An aspect and/or utility of the present general inventive concept is to provide a novel method of processing metal work pieces using a thermal gradient exchange.

Another aspect and/or utility of the present general inventive concept is also to provide a method to reduce a metal work piece processing time by using another work piece undergoing thermal processing.

Another aspect and/or utility of the present general inventive concept is also to provide a device utilizing a thermal gradient exchange in an essentially static gas or liquid medium.

Another aspect and/or utility of the present general inventive concept is also to provide a device which controls a movement of a metal work piece through an essentially static medium counter currently through a respective thermal gradient.

The present invention comprises a device and method for use of a thermal exchange gradient to alter a work material from ambient temperature through a gradient/range of temperature change, either above or below the original ambient temperature, then returning the mass/work material to the original ambient temperature. It is understood that the work material (piece) can be introduced into the gradient at other than ambient temperature as well, however ambient temperature is preferred.

Specifically, the invention comprises a method of thermally processing work pieces by providing a vertical chamber having an upper end, a lower end and an interior in which a thermal gradient is created by providing one of a convective heat source or compressor for coolant in thermal relation to the chamber on one of the upper or lower ends of the vertical chamber, and then disposing at least two work pieces within the interior of the chamber, one work piece lowering and another work piece raising in a directly countercurrent path from upper end to lower end and lower end to upper end, respectively, wherein a path is provided for each work piece of lowering them from the upper end of the chamber to the lower end of the chamber and returning the piece to the upper end of the chamber for removal. It is understood that the heating or cooling could be introduced at either end of the vertical chamber to establish the gradient, and further that the work piece could be introduced from the lower end of the chamber and moved up through the gradient and then returning to the lower end to complete its path.

An additional step of exchanging the work piece first lowered and raised from the upper end of the chamber to the lower end of the chamber and raised to the upper end of the chamber for a different work piece can be utilized (or if the piece is introduce at the lower end originally, then removal and exchange of pieces is effected at the lower end). After switching a work piece after completion of the path through the chamber a different work piece may then be thermally treated in an essentially continuous countercurrent cycle of thermal treatment and switching work pieces after completion of the treatment.

The movement of the work pieces through the path is performed slowly to allow for essentially 100% convective heat transfer and stabilization of the gradient in relation to the convective heat transfer capacity of a gas or liquid forming the gradient and the conductive capacity of the work piece and is timed in direct relation to density and cross thickness of the work pieces.

Additionally, the invention comprises the thermal processing apparatus for treating work pieces counter currently through a gradient, thereby achieving the method described. The apparatus comprises a vertical chamber having a gas or liquid disposed within the vertical chamber. Heat is added or subtracted from one end of the vertical chamber establishing a vertical temperature gradient by thermal relation of one of a convective heat source or a compressor containing coolant to an end of the chamber. (Chambers may comprise both a heat and cooling source, but it is understood that only one may be necessary, although both may be utilized to expand the range of the gradient.) The apparatus may also have a means for lowering and proportionally raising at least two work pieces in a countercurrent relation by lowering a first work piece through the temperature gradient while raising a second work piece already lowered through said temperature gradient. Additional means for switching work pieces after lowering and raising them through the temperature gradient may also be utilized.

The apparatus may also have an insulated vertical chamber. Instead of, or in addition to heating and cooling means, the apparatus may utilize a preheated or precooled gas or liquid disposed within said vertical chamber.

Certain of the foregoing and related aspects are readily attained according to the present general inventive concept by providing a method of thermally processing work pieces which includes providing a vertical chamber having an upper end, a lower end, and an interior, creating a thermal gradient in the interior of the chamber, disposing at least two work pieces within the interior of the chamber, providing a means for movement of the at least two work pieces wherein one work piece is lowered from the upper end of the chamber to the lower end of the chamber while a second work piece is moved counter currently in the opposing direction, and providing a path for each work piece wherein each work piece is first lowered from the upper end of the chamber to the lower end of the chamber and returned to the upper end of the chamber for removal.

The thermal gradient may be created by providing at least one of a convective heat source or compressor for cooling in thermal relation to said interior on at least one of the upper or lower ends of the vertical chamber.

The step of providing a path for each work piece, may include that each work piece is first raised from the lower end of the chamber to the upper end of the chamber and returned to the lower end of the chamber for removal.

The vertical chamber may be an insulated chamber. The chamber may be further be thermally insulated and provided in various sizes, shapes, and orientations.

The vertical chamber may be one of either a closed chamber or an open chamber.

The method may further include exchanging the work piece first lowered from the upper end of the chamber to the lower end of the chamber and then raised to the upper end of the chamber for a new work piece.

The method may further include switching each work piece after completion of the path through the chamber for a different work piece to be thermally treated in an essentially continuous countercurrent cycle.

The method may further include providing an alternative gas or liquid to ambient air within the interior of the chamber.

The method may further include timing a movement of the work pieces through the path in relation to the convective heat transfer capacity of the gas or liquid forming the gradient and the conductive capacity of the work piece.

The movement may be also timed in direct relation to density and cross thickness of the work pieces.

Certain of the foregoing and related aspects are readily attained according to the present general inventive concept by also providing a thermal processing apparatus for treating work pieces counter currently through a gradient including a vertical chamber, a gas or liquid disposed within said vertical chamber, at least one of a convective heat source or a compressor containing coolant for addition or subtraction of heat from one end of said vertical chamber establishing a vertical temperature gradient by thermal relation of at least one end of said convective heat source or compressor to said chamber, and means for lowering and proportionally raising at least two work pieces in a countercurrent relation by lowering a first work piece through said temperature gradient while raising a second work piece already lowered through said temperature gradient.

The thermal processing apparatus may further include a means for exchanging said work pieces for new work pieces after lowering and raising said work pieces through said temperature gradient.

Certain of the foregoing and related aspects are readily attained according to the present general inventive concept by also providing a method of thermal processing a work piece using another work piece which includes providing a chamber having a plurality of temperature zones, disposing a first work piece within a first temperature zone of the chamber, allowing a temperature of the first work piece to thermally equilibrate with the first temperature zone, moving the first work piece to a second temperature zone, and disposing a second work piece within the second temperature zone of the chamber, in fluid communication with the first work piece, wherein a thermal exchange occurs between the first and second work pieces.

The temperature of the first temperature zone may be less than a temperature of the second temperature zone.

The method may further include reducing a time required by the second work piece to thermally equilibrate with the first temperature zone by allowing the second work piece to thermally equilibrate with the first work piece in the second temperature zone.

The method may further include controlling a distance between the first work piece and the second work piece along a first direction (i.e., x-direction) and along a second direction (i.e., y-direction), wherein the first direction is perpendicular to the second direction.

The method may further include controlling a processing time the first work piece is exposed to the second work piece.

The processing time that the first work piece is exposed to the second work piece may be determined based on a temperature of the second work piece.

The first work piece and the second work piece may be moved counter currently with respect to each other.

Certain of the foregoing and related aspects are readily attained according to the present general inventive concept by also providing a method of thermally processing work pieces which includes providing an insulated chamber having a first end, an opposing second end, and a middle portion disposed between the first and second ends, wherein the first end is inclined with respect to middle portion, creating a thermal gradient within an interior of the insulated chamber, and providing a means for gradually moving a workpiece from the first end to the second end within the created thermal gradient.

The first end of the insulated chamber may be inclined between 5 to 90 degrees with respect to the middle portion.

The means for gradually moving the work piece may include a belt extending from the first end to the second end of the insulated chamber.

The insulated chamber may be formed in a U-shape, having the first end at a first elevation, a middle portion at a second elevation, and the second end at the first elevation.

The first elevation may be at a first temperature, the middle portion may be at a second temperature that is lower than the first temperature, and the second end may be at the first temperature.

Thermal gradient may be created by providing at least one of a convective heat source or compressor for cooling in thermal relation to an interior of the insulated chamber on at least one of the first or second ends of the insulated chamber.

The means for gradually moving the work piece may be timed to move the work piece based on a convective heat transfer capacity of a medium forming the thermal gradient.

The means for gradually moving the work piece may be timed to move the work piece based on a density and thickness of the work piece.

The general inventive concept is further described in the detailed description that follows, by reference to the noted drawings by way of non-limiting illustrative exemplary embodiments of the general inventive concept, in which like reference numerals represent similar parts throughout the drawings. As should be understood, however, the general inventive concept is not limited to the precise arrangements and instrumentalities illustrated.

An exemplary embodiment of the present general inventive concept, which in no way limits the claims will now be more particularly described by way of example with reference to the accompanying drawings, wherein:

DESCRIPTION OF THE PREFERRED EMBODIMENTS

Figure 1:
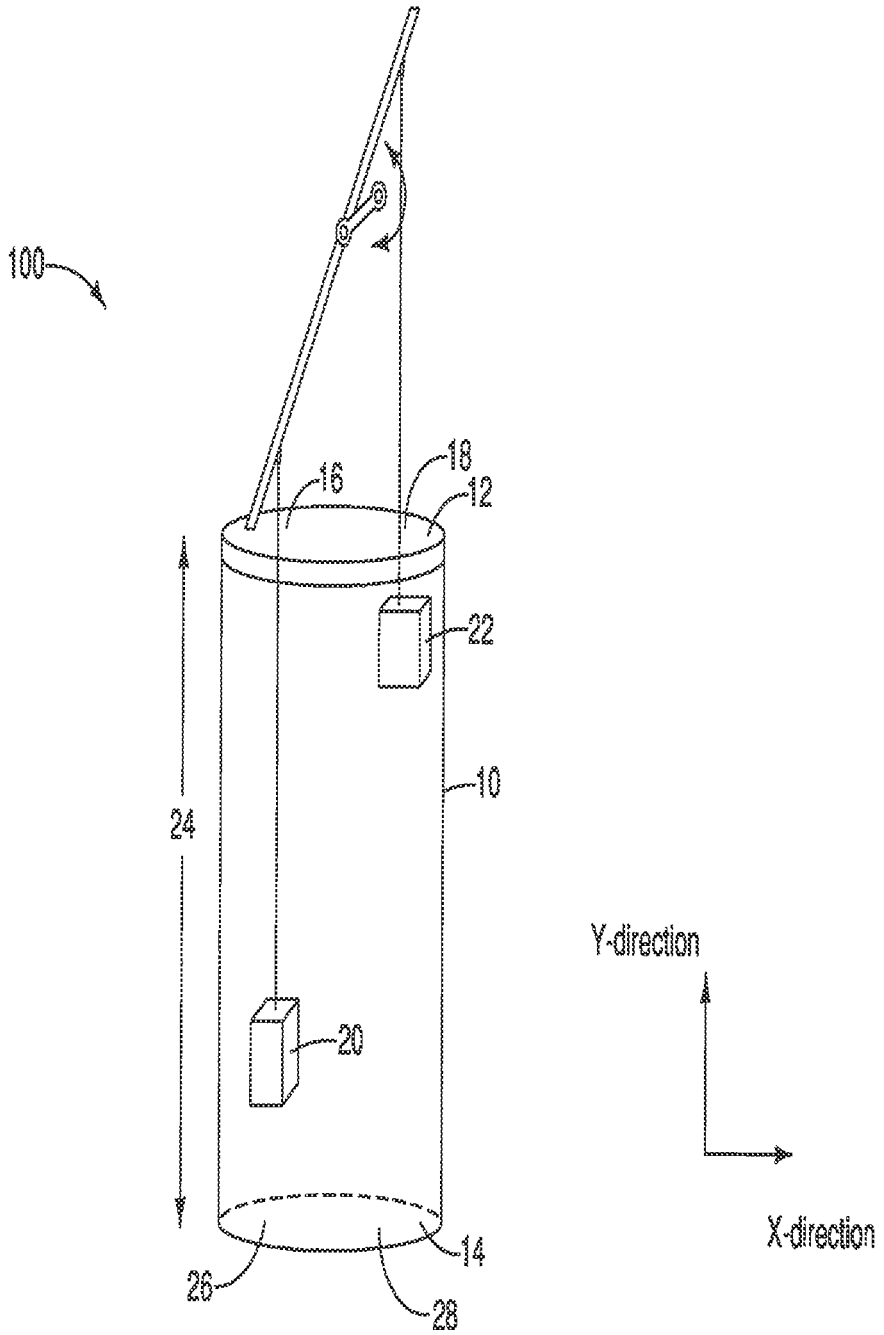
FIG. 1 depicts an insulated cylinder having transparent sides for illustrative purposes, lowering and raising two work pieces of equal mass through a thermal gradient within the cylinder counter currently.

The present inventive concept will now be described more fully with reference to the accompanying drawings, in which exemplary embodiments of the present general inventive concept are illustrated. The inventive concept may, however, be embodied in many different forms and should not be construed as being limited to the embodiments set forth herein; rather, these embodiments are provided so that this disclosure will be thorough and complete, and will fully convey the concept of the invention to those skilled in the art. Like reference numerals refer to like elements throughout.

The present invention comprises a device and method for a thermal exchange gradient to alter a work piece material from ambient temperature through a gradient/range of temperature change, either above or below the original ambient temperature, then returning the mass/work material to the original ambient temperature. This continuous thermal processing system 100 utilizes opposing directional moving masses within a vertical, preferably insulated structure. A preferred embodiment would comprise a cylindrical structure 10 of vertical orientation wherein the mass or work pieced 20, 22 are introduced at the upper end 12 or lower end 14 of the structure and are moved vertically (i.e., along the y-direction) from their origination point 16, 18 through a temperature gradient 24 as depicted in FIG. 1 to an opposing end 26, 28, and back to the point of origination 16, 18. This representation depicts a generalized chamber 10.

Figure 5:
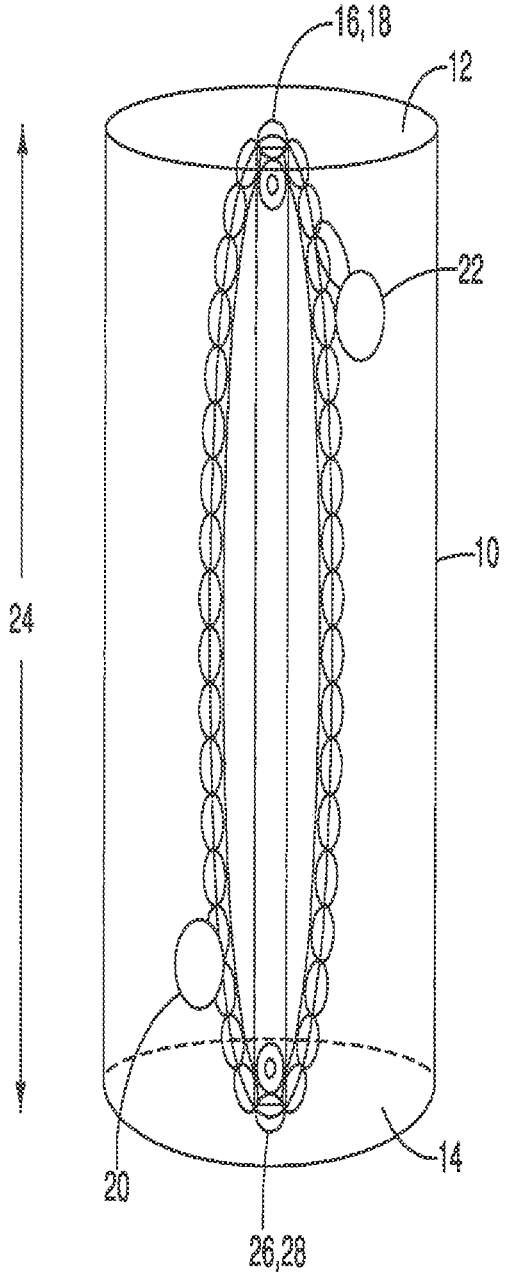
FIG. 5 depicts an insulated cylinder having transparent sides for illustrative purposes, lowering and raising two work pieces of equal mass through a thermal gradient within the cylinder counter currently by use of a belt having attachment means for the work pieces.

FIG. 5 depicts an alternate embodiment of the invention, showing a centrally disposed means for conveyance of the work pieces 20, 22, along a belt 30 rotating around two equal diameter mechanically rotated drums 32, with the belt depicting attachment means for the work pieces, here evenly spread links 34 for hook attachment. In such an embodiment particular care would have to be given to the spacing of the work pieces to ensure that the pieces were opposite and that the movement was therefore countercurrent.

Figure 2:
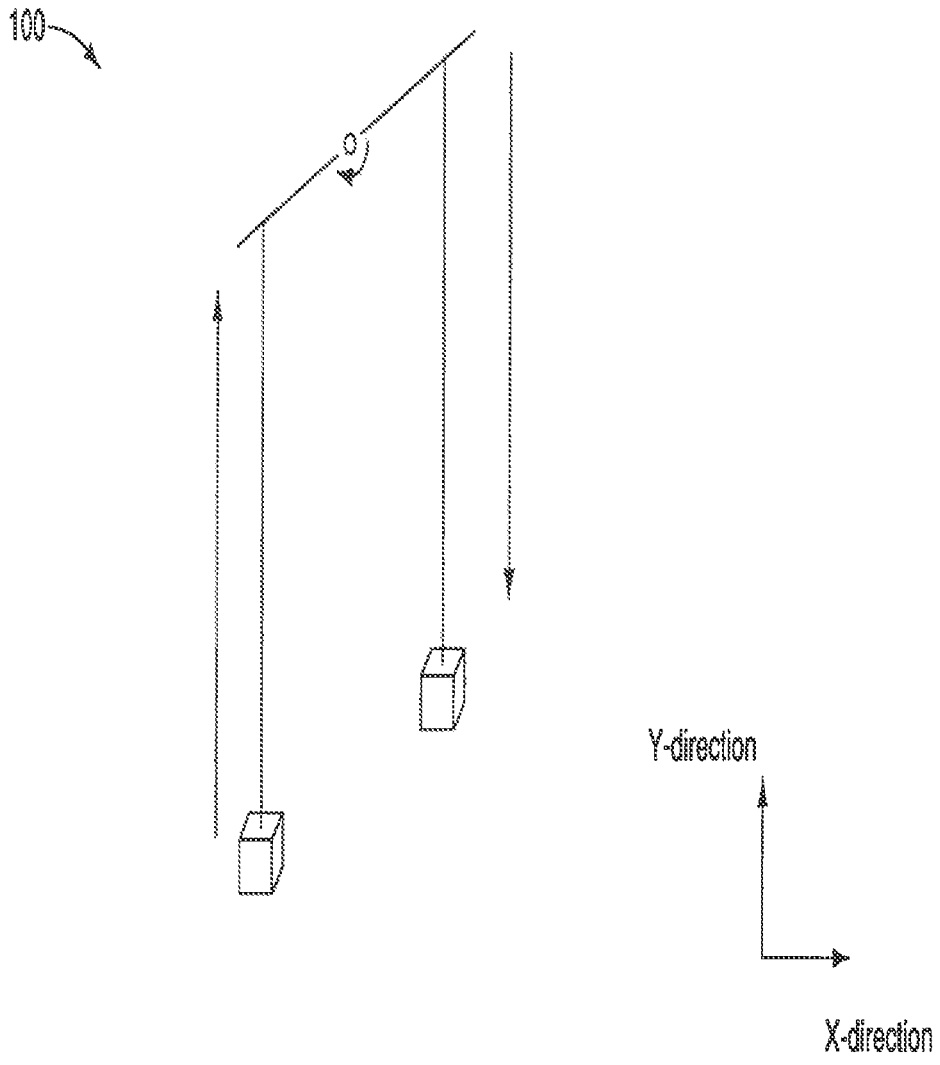
FIG. 2 depicts the countercurrent movement of the work pieces of FIG. 1 depicted for ease of understanding as weighted opposites on a lever rotated around a central axis to provide the downward movement of one mass and the strictly proportional movement upward of its opposing mass.

FIG. 2 depicts the countercurrent movement of the work pieces in a proportional manner.

Figure 3:
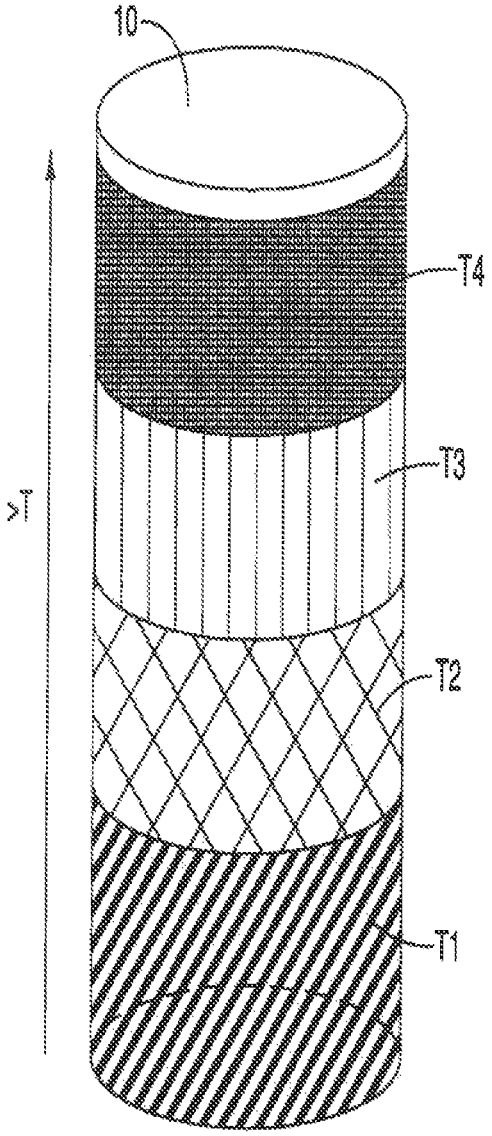
FIG. 3 depicts a thermal gradient (simplified) within an insulated chamber, wherein the temperature increases along a vertical axis of the chamber to form a gradient.

FIG. 3 represents a thermal gradient, specifically showing stratified layers of directionally increasing temperature ($\Delta T$) in a gradient along the vertical axis. While four distinct layers are depicted for ease of representation of $\Delta T$, it is understood that the layers would follow a natural distribution for a temperature gradient and be far less distinct. The specific result would be lowering or raising the temperature of the mass through the gradient and then returning the temperature of the mass to ambient temperature. In the preferred device of the present invention, means for exchanging the work piece for another after a raising and lowering (for example an opening in an otherwise closed chamber, switching/transporting methods for items known in the art such as conveyors, hooks, levers, etc., would also be applied.

The novel method differs from the previously mentioned art of non-gradient cooling methods. It accomplishes the same effect of these prior art heating or cooling cycles, but differs by utilizing movement of the work material (mass) through a natural striation of temperature within a closed highly insulated columnar system. Heat rises. Cold sinks. In an unstirred environment of gas or liquid a natural gradient will occur. A familiar example is a topless chest freezer in a food market, with an ambient temperature at the top, and very cold temperature at the bottom. Similarly a hot air balloon has the highest air temperature at the top of the balloon envelope and is near ambient at the open bottom. By adding movement of the mass through these thermal gradations over time, in particular with the preferred use of a countercurrent path of materials through the strata, a similar effect in the material is achieved as from high energy consumption static temperature methods.

In this method, heat transfer is guided by basic laws of thermodynamics, which defining how heat transfer relates to work done by a system, and limiting what it is possible for a system to achieve. Heat transfer is a process by which internal energy from one substance transfers to another substance. Under the kinetic theory, the internal energy of a substance is generated from the motion of individual atoms or molecules. Heat energy is the form of energy which transfers this energy from one body or system to another.

The heat transfer coefficient, in thermodynamics and in mechanical and chemical engineering, is used in calculating the heat transfer, typically by convection or phase change between a fluid and a solid:

$$h = \frac{q}{A - \Delta T}$$

where q=heat flow in input or lost heat flow, J/s=W h=heat transfer coefficient, $W/(m^2K)$ A=heat transfer surface area, $m^2$ ΔT=difference in temperature between the solid surface and surrounding fluid area, K The heat transfer coefficient is the proportional coefficient between the heat flux that is a heat flow per unit area, q/lund, and the thermodynamic driving force for the flow of heat (i.e., the temperature difference, ΔT). The heat transfer coefficient is also the inverse of thermal insulance.

The basic effect of heat transfer is that the particles of one substance collide with the particles of another substance. The more energetic substance will typically lose internal energy (i.e. "cool down") while the less energetic substance will gain internal energy (i.e. "heat up"). Thus the use of the countercurrent movement of work materials (masses) in the instant process and device allow for utilization of thermodynamic laws, providing for transfer of heat from one substance to another.

This is seen with the concept of heat capacity of an object—how that object's temperature responds to absorbing or transmitting heat. Heat capacity is defined as the change in heat divided by the change in temperature. When adding heat to a system, only two results are possible—change of the internal energy of the system or causing the system to do work (or, of course, some combination of the two). All of the heat energy must go into doing these things. The use of the countercurrent movement of work pieces prevents thermal equilibrium of the system except as a gradient, thus maintaining the thermal gradient.

Figure 6:
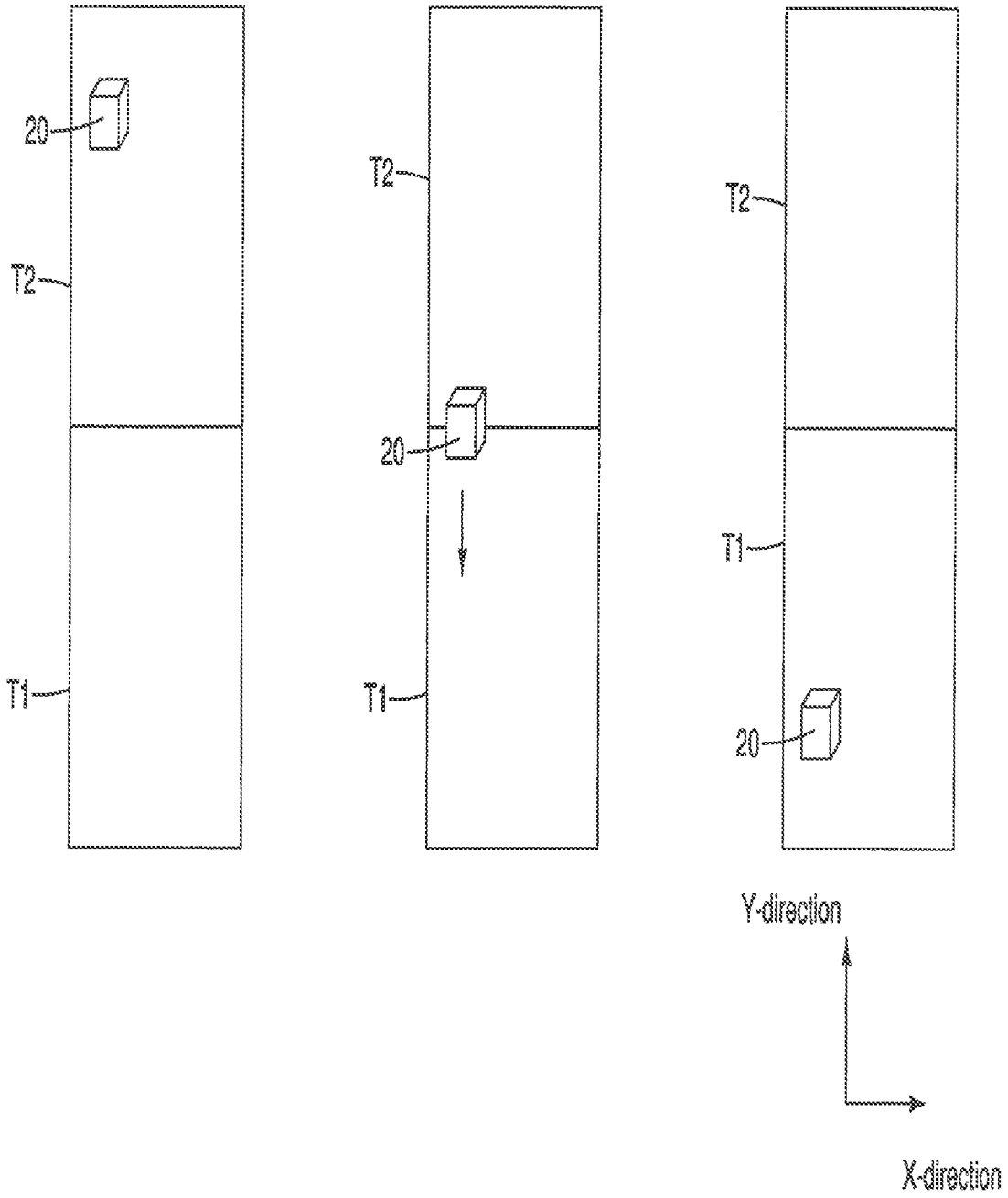
FIG. 6 illustrates a process used by the method for thermal processing a work piece according to an exemplary embodiment of the present general inventive concept, wherein a first work piece is lowered into the insulated cylinder having a first temperature zone T1 and a second temperature zone T2.

FIG. 6 illustrates a process used by a method for thermal processing a work piece according to an exemplary embodiment of the present general inventive concept, wherein a first work piece 20 is lowered into the insulated cylinder 10 having a first temperature zone T1 and a second temperature zone T2.

Thermal equilibrium is when two regions that are in thermal contact no longer transfer heat between them. More specifically, thermal equilibrium occurs when a steady state of temperatures between bodies or regions within a system occurs.

Referring to FIG. 6, the method according to an exemplary embodiment of the present general inventive concept includes placing a first work piece 20, which has an initial temperature equal to ambient temperature Ta, into the cylindrical structure 10 (i.e., chamber). As described above, the interior of the chamber 10 is subjected to a temperature gradient, wherein a temperature of temperature zone T2 is greater than a temperature of temperature zone T1 (FIG. 3).

As the first work piece 20 is placed into the chamber 10, a heat exchange occurs between the first work piece 20 and the interior of the chamber 10 at temperature zone T1. Heat from the larger temperature work piece 20 moves toward the lower temperature zone T1. At some point, a thermal equilibrium occurs such that the temperature of the first work piece 20 is equal to the temperature at temperature zone T1.

Similarly, as the first work piece 20 is lowered from temperature zone T1 to temperature zone T2, a heat exchange occurs between the first work piece 20 and the interior of the chamber at temperature zone T2. However, since the temperature difference between T2 and T1 is less than a temperature difference between ambient temperature Ta and T1, a new thermal equilibrium occurs much quicker.

Figure 7:
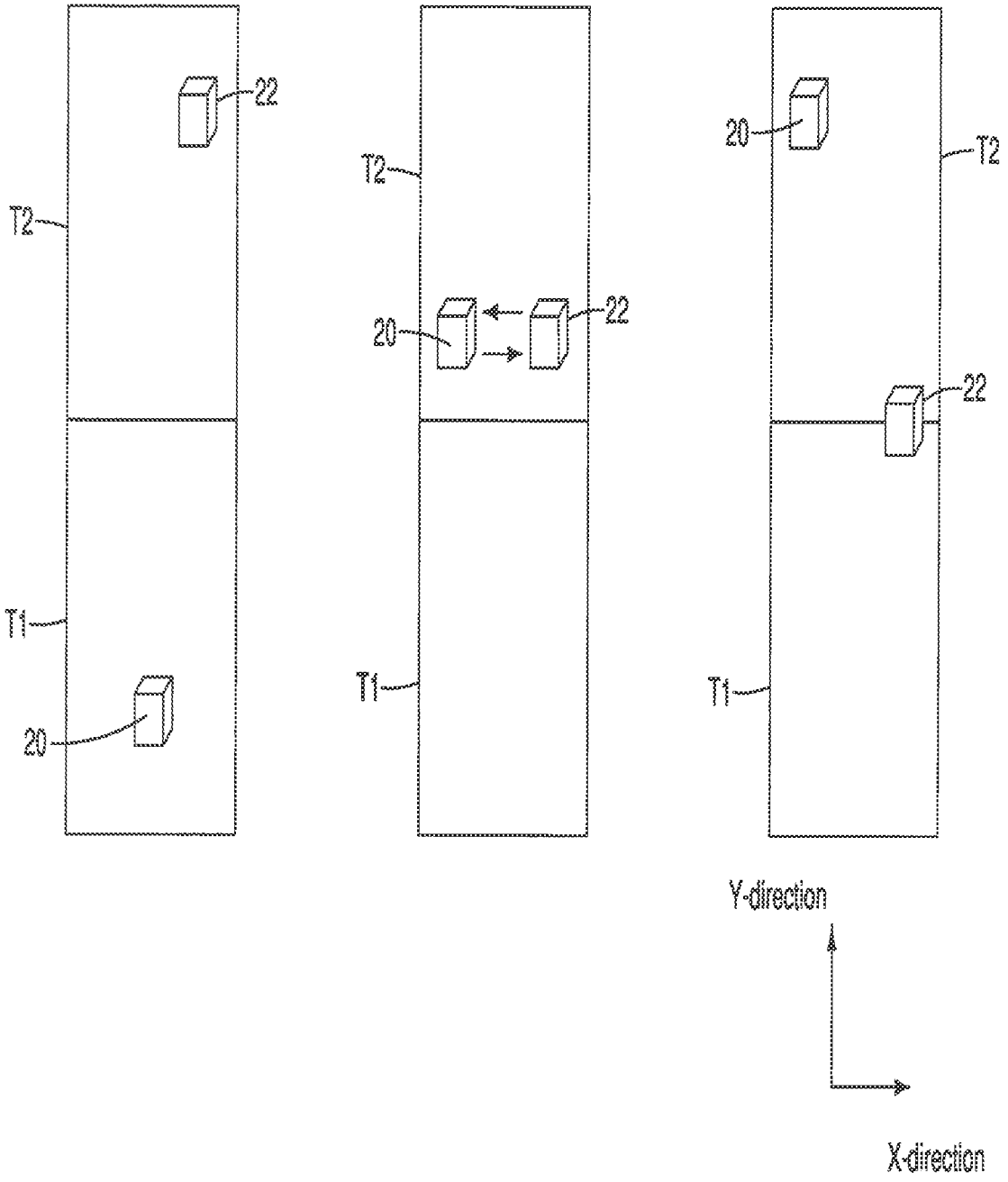
FIG. 7 illustrates a process used by the method for thermal processing a second work piece according to an exemplary embodiment of the present general inventive concept, wherein the second work piece is lowered into the insulated cylinder, adjacent to the first work piece undergoing thermal processing. It should be understood that the use of only two temperature zones is to focus on the transition of the workpiece. In most embodiments there will be a larger number of temperature zones.

FIG. 7 illustrates a process used by the method for the thermal processing of a second work piece 22 according to an exemplary embodiment of the present general inventive concept, wherein the second work piece 22 is lowered into the insulated cylinder, adjacent to the first work piece 100 undergoing thermal processing.

As illustrated in FIG. 7, as the first work piece 20 is moved from temperature zone T1 toward the higher temperature zone T2, a second work piece 22 is moved from an external environment having an ambient temperature Ta, into temperature zone T2. Since the second work piece 22 is in fluid communication with temperature zone T2 and the first work piece 20 which had thermally equilibrated at temperature zone T1, a time for the second work piece 22 to reach thermal equilibrium with temperature zone T2 is much quicker. In other words, a previously disposed work piece 20, which has been allowed to thermally equilibrate with a lower temperature zone T1, will reduce the time required for a new work piece to thermally equilibrate with temperature zone T2.

For instance, for illustration purposes only, assume an ambient temperature Ta of 72° F., a temperature zone T2 of 31° F., and a temperature zone T1 of −320° F. Referring to FIG. 7, as the second work piece 22 (at ambient 72° F.) is lowered into temperature zone T2 (at 31° C.), the first work piece 20 (at −320° F.) is raised into temperature zone T2. The combined effect of temperature zone T2 (at 31° F.) and the first work piece 20 (at −320° F.) on the second work piece 22 substantially reduces the time required for the second work piece 22 to arrive at thermal equilibrium with temperature zones T1 and T2.

The method according to the present general inventive concept substantially reduces a time required to process work pieces by exposing a new work piece to a work piece that has already thermally equilibrated with a lower temperature zone (T1) within the chamber 10. As the thermally equilibrated work piece is moved from the lower temperature zone (T1) to a higher temperature zone (T2), the temperature difference ΔT (T2−T1) facilitates a heat exchange between the two work pieces, thereby reducing a time required for the new work piece to thermally equilibrate with temperature zone T2. Once the second work piece is at or near equilibrium with the higher temperature zone T2 and the first work piece, the second work piece may then be moved into the first temperature zone T1. However, since the second work piece has been exposed to the colder work piece, the time required for the second work piece to thermally equilibrate with the first temperature zone T1 is substantially reduced.

In addition, the simultaneous movement of the first work piece and the second work piece into the second temperature zone T2 promotes a forced convection effect, further reducing a time the second work piece is thermally equilibrated at the second temperature zones T1, T2.

In the related art, although convective heat transfer can be derived analytically through dimensional analysis, exact analysis of the boundary layer, approximate integral analysis of the boundary layer and analogies between energy and momentum transfer, these analytic approaches ma not offer practical solutions to all problems when there are no mathematical models readily applicable. As such, many correlations were developed in the art to estimate the convective heat transfer coefficient in various cases including natural convection, forced convection for internal flow and forced convection for external flow in order to approximate "dimensionless" analysis. These empirical correlations are presented for their particular geometry and flow conditions.

As the fluid properties are temperature dependent, they are evaluated at the film temperature $T_f$, which is the average of the surface $T_s$ and the surrounding bulk temperature, $T_\infty$.

$$T_f = \frac{T_s + T_\infty}{2}$$

$Nu_L$, the "dimensionless" heat transfer coefficient, applies to all fluids for both laminar and turbulent flows, L is the characteristic length with respect to the direction of gravity.

$$h = \frac{k}{L}\left[0.825 + \frac{0.387Ra_L^{1/6}}{[1 + (0.492/Pr)^{9/16}]^{8/27}}\right]^2$$

Therefore, for laminar flows in the range of $Ra_L<10^9$, the following equation can be further improved.

$$h = \frac{k}{L}\left[0.68 + \frac{0.67Ra_L^{1/4}}{[1 + (0.492/Pr)^{9/16}]^{4/9}}\right] Ra_L \leq 10^9$$

For cylinders with their axes vertical, the expressions for plane surfaces can be used provided the curvature effect is not too significant. This represents the limit where boundary layer thickness is small relative to cylinder diameter D. The correlations for vertical plane walls can be used when $$\frac{D}{L} \geq \frac{35}{Gr_L^{\frac{1}{4}}}$$

Example

Figure 4:
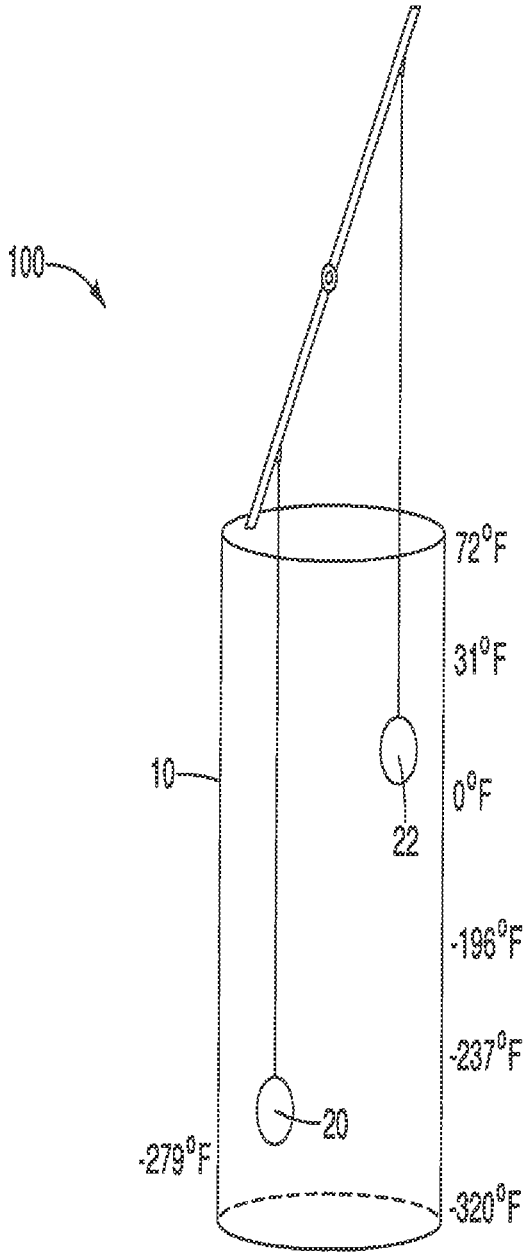
FIG. 4 depicts an open system with a thermal gradient displayed in a generalized manner relative to the height of the cylinder, showing a lowest temperature of −320° F. at the bottom of the cylinder and 72° F., ambient temperature, at the top of the cylinder. Work piece 20, which has been lowered significantly in the chamber will have a temperature corresponding to the strata of temperature in the gradient, here, at −279° F., while work piece 22, which is significantly higher in the chamber, will exhibit a temperature relative to its strata, or 0° F.

An example of a preferred method of the invention comprises utilizing a insulated cylinder ten feet high containing 20 gallons of −320° F. liquid nitrogen at the bottom of the cylinder, with a natural gradient from −320° F. at the bottom to 72° F. at the top of the open (to ambient temperature) cylinder. Two identical masses of steel suspended at any given height will reflect the specific gradient temperature at that height, given enough time for 100% convective heat transfer and stabilization. For example, as shown in FIG. 4, a gradient is depicted from the bottom of the cylinder showing the liquid nitrogen at −320° F., progressing to ambient temperature at 72° F. at the top of the open cylinder. Two work pieces, depicted as 20 and 22, will have a temperature relative to the specific gradient at that height, or, as shown for piece 20, −279° F., and for piece 22, 0° F.

The necessary amount of time is calculated based on the mass and conductive capacities of the work materials/steel and the convective heat transfer capacity of the medium (here, nitrogen gas). Movement of the gas would accelerate the heat transfer from accelerated molecular convective transfer. This process variable is also known as a specific correlation coefficient. Therefore, raising one mass through the medium while lowering the other will result in a differential in temperature between the two masses. Hence if one mass is at the bottom and raised as a second mass is introduced and lowered, the mass lowering will give up heat while the one raising will gain heat. This becomes a continuous cycle with new masses introduced at the top. One enters the cycle and another leaves the cycle. The gradient will then continue as a mirror sinusoidal wave of lowered temperature and raised temperature for two identical masses.

It is to be understood that the foregoing illustrative exemplary embodiments have been provided merely for the purpose of explanation and are in no way to be construed as limiting of the present general inventive concept. For example, the alignment head may be smooth or comprise additional locking features such as a grooved portion that may engage with a raised portion within the alignment slots of the jaw inserts. Words used herein are words of description and illustration, rather than words of limitation. In addition, the advantages and objectives described herein may not be realized by each and every exemplary embodiment practicing the present general inventive concept. Further, although the present general inventive concept has been described herein with reference to particular structure, steps and/or exemplary embodiments, the present general inventive concept is not intended to be limited to the particulars disclosed herein. Rather, the present general inventive concept extends to all functionally equivalent structures, methods and uses, such as are within the scope of the appended claims. Those skilled in the art, having the benefit of the teachings of this specification, may affect numerous modifications thereto and changes may be made without departing from the scope and spirit of the present general inventive concept.

Figure 8:
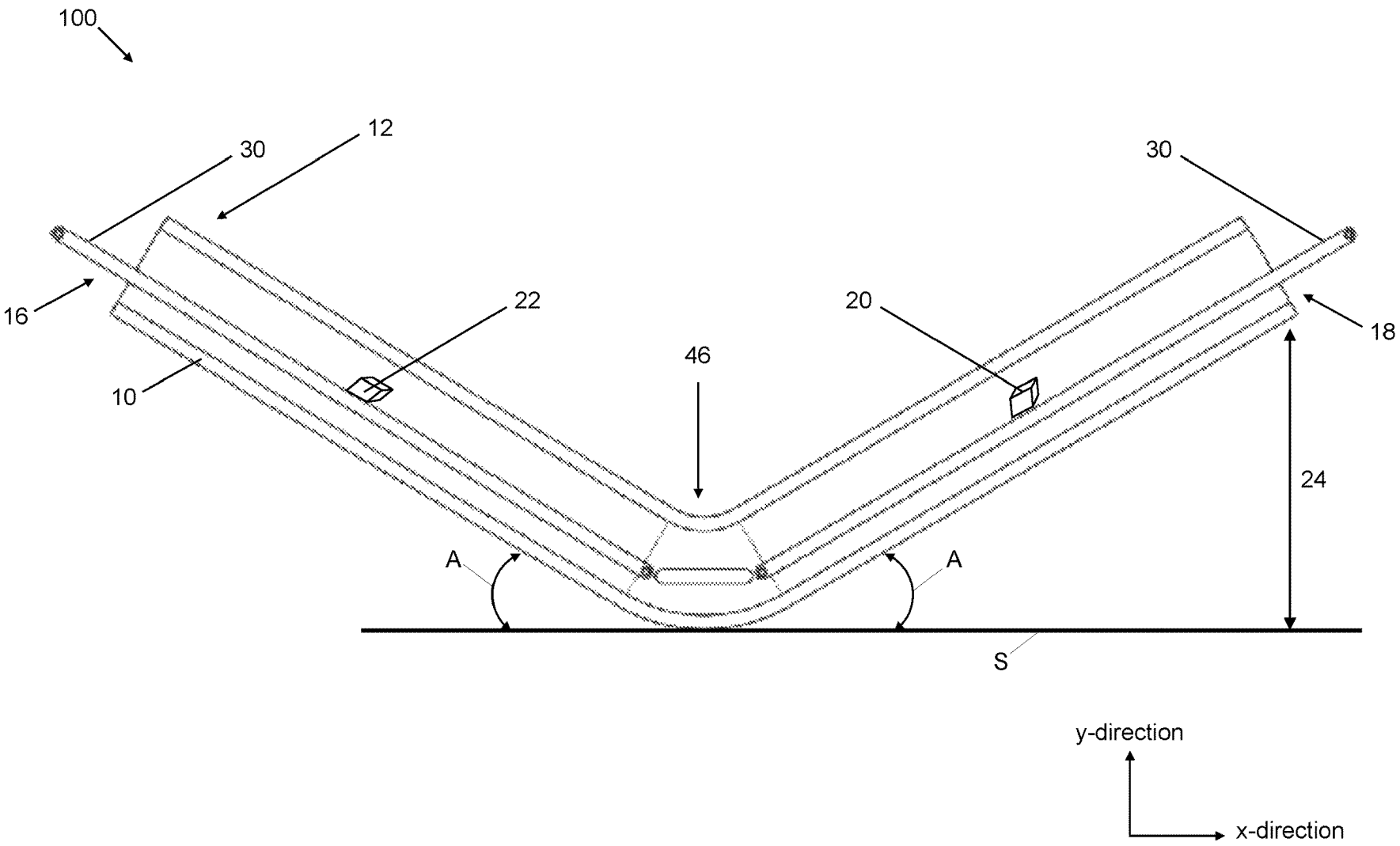
FIG. 8 illustrates insulated cylinders coupled together for continuous processing of workpieces.

FIG. 8 illustrates a U-shaped insulated cylinder for continuous processing of work pieces. This continuous thermal processing 100 utilizes moving masses within a vertical or inclined insulated structure 10. This continuous thermal processing system 100 utilizes an internally disposed means for conveyance of work pieces 20, 22, along a belt 30 to gradually bring work pieces from an initial elevation (origination point 16) of at least 2 feet above ground level to a position at ground level and then back to the initial elevation 18 within a temperature gradient 24, as depicted in FIG. 8. However, the present general inventive concept is not limited thereto. That is, in alternative embodiments, the U-shaped insulated cylinder allows work pieces 20, 22 to move vertically (i.e., along the y-direction) from their origination point 16 at a first temperature (i.e., ambient temperature) through the temperature gradient 24 to a middle portion 46 at a second temperature, lower than the first temperature, then back to their conclusion point 18 being at the same elevation of the origination point 16.

The work pieces 20, 22 are introduced at the upper end 12 of the insulated cylinder 100 onto a belt 30 and gradually moved vertically or in a declined direction from their origination point 16 through a temperature gradient 24 to a middle portion 46 and then back to an origination elevation at an opposing end 18. The present invention comprises a device and method for thermal exchange to alter work piece materials, continuously. That is, each work piece 20, 22 is fed gradually through the temperature gradient 24 from a first elevation at 16 having a first temperature to a second elevation having a temperature lower than the first elevation at 46 and then finally returning to the same first elevation at the opposing end 18. As a result, work pieces may be processed on a continuous basis, beginning at a first end 16 of the U-shaped cylinder 100 and completing a cycle at the opposing end 18. In the present embodiment, the insulated cylinder 10 is inclined with respect to a surface S at an angle A of about 5 degrees to about 90 degrees. However, the present general inventive concept is not limited thereto. That is, the angle A of the insulated cylinder 10 with respect to the surface S may be between 15 and 45 degrees and the origination elevation is at least 2 feet above the surface S.

INDUSTRIAL APPLICABILITY

Primarily the invention will be utilized for a mass that gains a physical benefit from thermal processing, either heat treating or cold processing. What is gained by this process is a significantly lower cost of processing, enabling a broader market adoption of new parts to be processed that were not economically viable with existing heating/cooling methods, or a new efficiency for items currently being processed, at a new lower cost, offering a significant competitive advantage. The size of the objects to be process is no longer limited and thus the process can lend itself to such things as the cryogenic stabilization of large metal components to cite just one example.

What is claimed is:

1. A method of thermally processing work pieces comprising:

providing an insulated chamber having a first end, an opposing second end, and a middle portion disposed between the first and second ends, wherein the first end is inclined with respect to the middle portion;

creating a thermal gradient within an interior of the insulated chamber, the first and second ends maintained at a first temperature and the middle portion maintained at a second temperature;

disposing at least two work pieces within an interior of the insulated chamber, wherein the at least two work pieces include a first work piece and a second work piece; and providing a means for gradually moving a workpiece from the first end to the second end within the created thermal gradient, wherein the first and second work pieces are positioned in the insulated chamber at the same time after allowing the first work piece to equilibrate with the second temperature.

2. The method of claim 1, wherein the first end of the insulated chamber is inclined between 5 to 70 degrees with respect to the middle portion.

3. The method of claim 1, wherein the means for gradually moving the work piece includes a belt extending from the first end to the second end of the insulated chamber.

4. The method of claim 1, wherein the insulated chamber is formed in a U-shape, having the first end at a first elevation, the middle portion at a second elevation, and the second end at the first elevation.

5. The method of claim 4, wherein the first elevation is at a first temperature, the middle portion is at a second temperature that is lower than the first temperature, and the second end is at the first temperature.

6. The method of claim 1, wherein the thermal gradient is created by providing at least one of a convective heat source or compressor for cooling in thermal relation to an interior of the insulated chamber on at least one of the first or second ends of the insulated chamber.

7. The method of claim 1, wherein the means for gradually moving the work piece is timed to move the work piece based on a convective heat transfer capacity of a medium forming the thermal gradient.

8. The method of claim 1, wherein the means for gradually moving the work piece is timed to move the work piece based on a density and thickness of the work piece.

* * * * *